United States Patent [19]

Wallace et al.

[11] 4,030,728

[45] June 21, 1977

[54] DOCUMENT TRANSPORT APPARATUS

[75] Inventors: Harry L. Wallace, Garden City; William B. Templeton, Howell, both of Mich.

[73] Assignee: Burroughs Corporation, Detroit, Mich.

[22] Filed: Apr. 21, 1976

[21] Appl. No.: 678,750

[52] U.S. Cl. ..... 271/277; 198/695; 271/205

[51] Int. Cl.[2] ..... B65H 5/14

[58] Field of Search ..... 271/277, 205, 275; 198/180, 134, 695, 179; 226/173

[56] References Cited

UNITED STATES PATENTS

| | | | |
|---|---|---|---|
| 1,861,282 | 5/1932 | Nelson | 198/180 X |
| 1,991,137 | 2/1935 | Case et al. | 271/205 |
| 3,019,855 | 2/1962 | Engle | 226/173 UX |
| 3,308,544 | 3/1967 | White | 226/173 X |

OTHER PUBLICATIONS

Rembecki, J. S., "Conveyor Belt", *IBM Technical Disclosure Bulletin*, vol. 8, No. 6, Nov. 1965, P. 896.

*Primary Examiner*—John J. Love
*Assistant Examiner*—Bruce H. Stoner, Jr.
*Attorney, Agent, or Firm*—Robert J. Gaybrick; Richard Jordan; Kevin R. Peterson

[57] ABSTRACT

A document transport apparatus for serially transporting sheet material over a preselected transport path including an endless belt having a resilient compressible tubular base member and gripping members projecting therefrom. The gripping members are normally closed when the base member is uncompressed. The apparatus further includes pulleys at opposite ends of the transport path, the belt being entrained in the grooves of the pulleys. The grooves are dimensioned to compress the portion of the base member entrained therein, thereby opening the gripping members projecting from the compressed portion of the base member, permitting insertion or removal of a document. The belt grips the document and carries it along with it in the space between the pulleys.

7 Claims, 3 Drawing Figures

DOCUMENT TRANSPORT APPARATUS

BACKGROUND OF THE INVENTION

1. Field of the Invention

The invention relates broadly to transport apparatus and more particularly to apparatus for transporting documents along a preselected path.

2. Description of the Prior Art

Many types of document transport apparatus are known in the prior art, some of which are particularly useful for the rapid movement of documents such as bank checks or the like. One such apparatus includes two substantially parallel vertical walls forming a transport guideway, and further includes means such as driven rollers or the like for propelling the documents through the guideway between the walls. The apparatus is designed so that the documents travel serially through the guideway; however, it is known that they can and sometimes do bunch up, become folded or creased and thus obstruct the transport guideway and become further mutilated therein. Furthermore, prior art devices employing the above-described system, which is often called upon to transport thousands of documents past a given point per minute, are quite noisy, as the documents impact upon the guideway and each other and flutter back and forth between the walls.

Transport apparatus utilizing a chain or belt as the conveyor are also known in the art. U.S. Pat. No. 475,723, issued to J. C. Coram et al, discloses a paper feeding device in which a chain carries a plurality of gripping fingers that releasably grasp the sheet of paper being transported. A separate release mechanism cooperates with the fingers to release the paper. The disclosed chain drive can be, however, quite noisy and the release mechanism must be precisely adjusted for proper operation. Furthermore, the apparatus disclosed therein would be costly to manufacture and assemble, and would be cumbersome to service.

U.S. Pat. No. 1,991,137, issued to C. Z. Case et al, discloses a conveyor in which a flexible belt having a square cross section is utilized for feeding photographic film. The belt has a slit along one diagonal, the slit being opened by stretching and bending the belt back on itself at a substantial angle. This places considerable strain on the belt and precludes release of the transported material at intermediate points along a straight transport path. Additionally, since the slit opens when the belt is bent, if it is desired that the transported material turn a corner apparatus must be provided to insure that the slit remains closed.

SUMMARY OF THE INVENTION

It is accordingly an object of this invention to provide a simple, efficient and effective document transport apparatus for the high-speed transport of documents along a preselected transport path.

It is another object of this invention to provide an apparatus for transporting documents without generating the noise generally associated with high-speed document transport.

It is yet another object of this invention to provide a high-speed transport apparatus that includes a single moving belt that grasps an edge of the document to be transported and carries it along therewith.

It is a further object of the invention to provide a belt-driven high-speed document transport apparatus wherein the belt releasably grasps the document being transported and responds to a squeezing force applied thereto as it is guidingly driven to release the document in the region of the belt to which the squeezing force is applied.

It is still another object to provide a high-speed document transport apparatus having a moving belt that releasably grasps the documents being transported and that responds to a squeezing force applied thereto to release the document in the region of the belt to which the squeezing force is applied, and further including pulleys cooperating with the belt to apply the squeezing force thereto.

It is a further object of this invention to provide a belt for use in a document transport apparatus that releasably grasps the document being transported and that responds to a squeezing force applied thereto to release the document in the region of the belt to which the squeezing force is applied.

BRIEF DESCRIPTION OF THE DRAWINGS

The aforementioned objects and features of this invention, as well as other objects and features thereof, will be better understood upon consideration of the following detailed description when read in conjunction with the drawings, in which.

DETAILED DESCRIPTION OF THE PREFERRED EMBODIMMENT

Figure 2B:
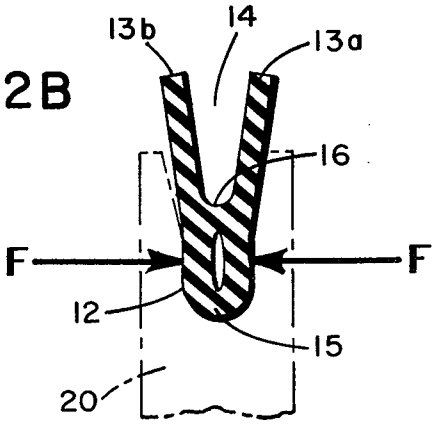
FIG. 2B is a cross-sectional view of the endless belt at point B—B of FIG. 1.
Figure 1:
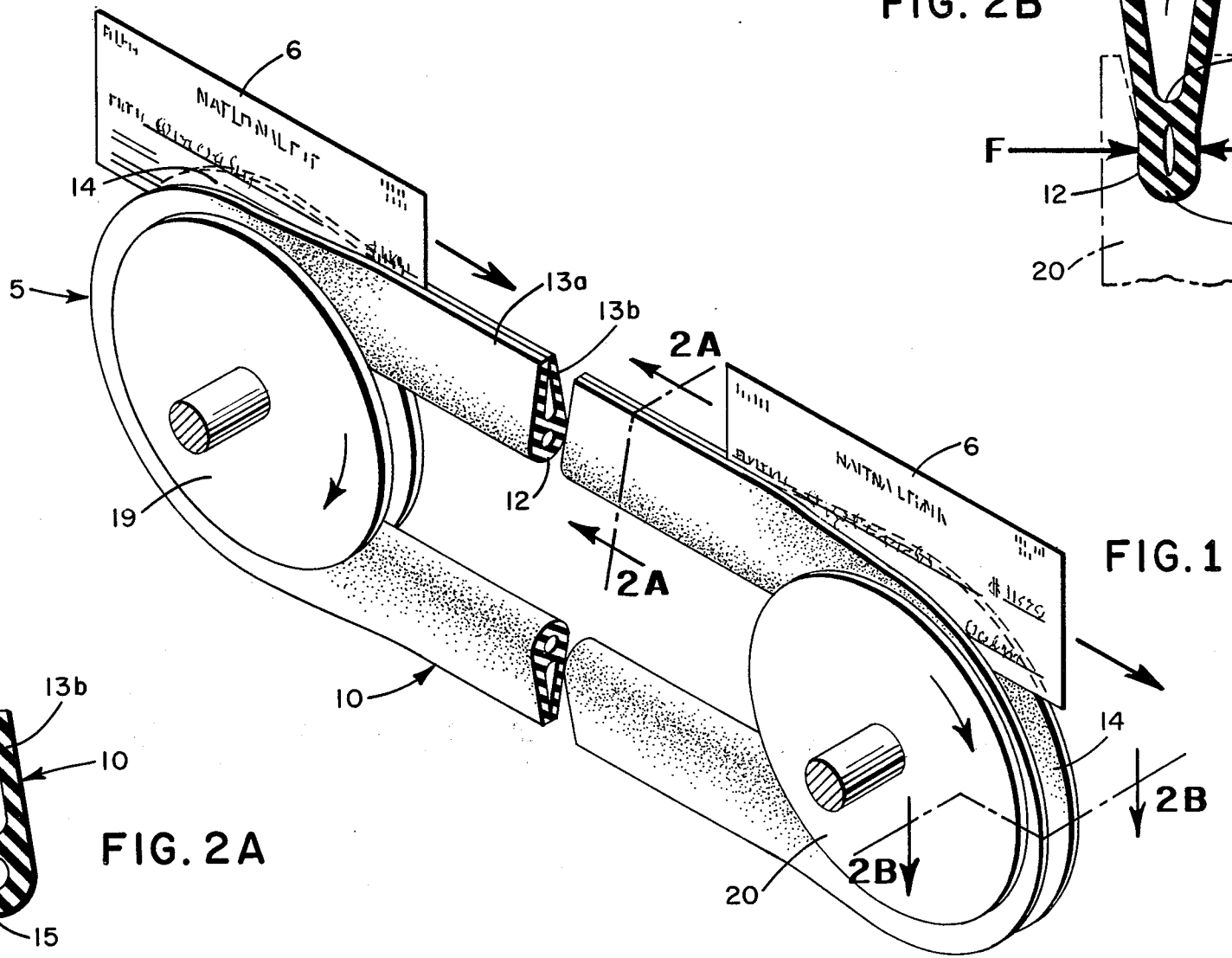
FIG. 1 shows a perspective view of the herein-disclosed document transport apparatus.
Figure 2A:
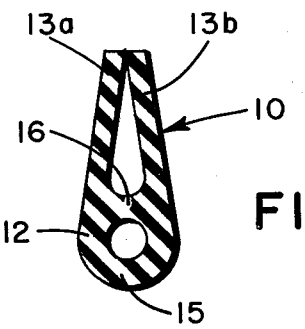
FIG. 2A is a cross-sectional view of the endless belt, at point A—A of FIG. 1.

With reference to FIG. 1, the novel document transport apparatus generally designated at 5, is provided with an endless belt 10 of suitable resilient material and pulleys 19 and 20. Pulley 19 is provided at the document insertion end of transport apparatus 5 and pulley 20 is at the document release end thereof. With reference to FIGS. 2A and 2B, belt 10 is provided with compressible resilient tubular member 12 including spacer portion 16 and keeper portion 15. Belt 10 is further provided with flat gripping members **13*a* and 13*b* attached to opposite sides of tubular member 12. The gripping members 13*a* and 13*b* project outwardly from the tubular member 12 towards the exterior of the loop created by belt 10. As shown in FIG. 2A, the distal ends of the gripping members 13*a* and 13*b* are contiguous to each other when the tubular base member 12 is normally uncompressed. With reference to FIG. 2B, the distal ends of gripping members 13*a* and 13*b* may be opened by providing a squeezing force designated F to opposite sides of tubular member 12 which forces the distal ends of gripping members 13*a* and 13*b*** apart.

In operation, one or both of pulleys 19 and 20 are caused to rotate by conventional means, which thereupon causes belt 10 to move through a preselected transport path with pulleys 19 and 20 at the ends thereof. The grooves of each pulley 19 and 20 are dimensioned to provide the squeezing force F to the tubular member 12 of belt 10 entrained in the respective grooves of pulleys 19 and 20; whereupon the gripping members **13*a* and 13*b* in the portion of belt 10 entrained in pulleys 19 and 20 are forced open. This allows insertion of a document 6 into, or removal of a document 6 from the slot 14 at these points. Between pulleys 19 and 20 gripping members 13***a* and 13*b* grip document 6 and belt 10 carries the document 6 along the transport path between pulleys 19 and 20.

Having described the preferred embodiment of this invention, it will occur to those skilled in the art that various modifications may be made without departing from the scope of the invention. It is expressly understood that the scope of the invention is not limited to the embodiment disclosed herein but only as indicated in the appended claims.

What is claimed is:

1. Apparatus for serially transporting sheet material such as documents or the like over predetermined transport path comprising:

a. an endless belt including i. a resilient compressible tubular base member forming a loop, and ii. gripping members each having a proximate edge and a distal edge, said proximate edges of said gripping members being attached to and projecting from respective opposite sides of said base member, and said distal edges being in close contiguity to each other outside said loop when said base member is normally uncompressed; and b. a pair of rotatable supporting members within said loop situated at opposite ends of said transport path, at least one of said supporting members constituting a pulley having a groove in which said belt is entrained as it travels through said transport path, said groove being dimensioned to compress the portion of said base member entrained in said groove to thereby separate said distal ends of said gripping members attached to said compressed base portion.

2. Apparatus as defined in claim 1 in which said base member has a circular cross-section.

3. Apparatus as defined in claim 1 in which said gripping members attached to respective sides of said base member form continous gripping members.

4. Apparatus as defined in claim 1 in which both of said supporting members comprise pulleys in the grooves of which the belt is situated.

5. Apparatus s defined in claim 4 in which the groove of each pulley is dimensioned to compress the portion of said base member situated therein.

6. Apparatus as defined in claim 1 in which the gripping members are resilient.

7. Apparatus for serially transporting sheet material such as documents or the like over a predetermined transport path comprising:

a. and endless belt including i. a resilient compressible tubular base member forming a loop, and ii. a pair of continuous resilient gripping members each having a proximate edge and a distal edge, said proximate edges being attached to and projecting from respective opposite sides of said base member and said distal edges being in close contiguity to each other outside said loop when said base member is normally uncompressed; and b. a pair of pulleys situated within said loop at opposite ends of said transport path, said base member being entrained in the respective grooves of said pulleys as said belt moves through said transport path, said pulleys being dimensioned to compress the portion of said base member entrained in said groove to thereby separate said distal edges of the portion of said gripping members attached to said compressed portion.

* * * * *